United States Patent [19]

Faste et al.

[11] Patent Number: 4,487,247

[45] Date of Patent: Dec. 11, 1984

[54] CHILL CASTING METHODS

[75] Inventors: Heinrich Faste, Grossenkneten; Ali Bindernagel, Wermelskirchen, both of Fed. Rep. of Germany

[73] Assignee: Kocks Technik GmbH & Co., Hilden, Fed. Rep. of Germany

[21] Appl. No.: 403,354

[22] Filed: Jul. 30, 1982

[30] Foreign Application Priority Data

Sep. 2, 1981 [DE] Fed. Rep. of Germany ..... 3134699

[51] Int. Cl.[3] ..... B22D 27/04

[52] U.S. Cl. ..... 164/126; 164/128; 164/348

[58] Field of Search ..... 164/348, 118, 122, 125, 164/126, 128, 297, 144, 443, 444, 485, 486

[56] References Cited

U.S. PATENT DOCUMENTS

| | | | |
|---|---|---|---|
| 1,895,135 | 1/1933 | Rohn | 164/348 X |
| 2,412,601 | 12/1946 | Carrington | 164/297 X |
| 2,884,671 | 5/1959 | Walcher, Sr. et al. | 164/348 |
| 3,633,656 | 1/1972 | Saunders | 164/348 |
| 4,162,700 | 7/1979 | Kahn | 164/348 X |

FOREIGN PATENT DOCUMENTS

| | | | |
|---|---|---|---|
| 639856 | 12/1936 | Fed. Rep. of Germany | 164/118 |

*Primary Examiner*—Kuang Y. Lin

*Attorney, Agent, or Firm*—Buell, Ziesenheim, Beck & Alstadt

[57] ABSTRACT

A thin walled chill mould is provided with several cooling chambers by which the intensity of cooling can be varied during casting. During pouring, cooling of the lowermost chamber is commenced first and with low intensity. As filling continues, cooling by the other cooling chambers is commenced successively and at increasing intensities. After filling is complete, cooling is continued at these different intensities until the mould has been closed and tilted to the horizontal. Thereafter cooling is continued at maximum intensity in all chambers while the mould is rotated about its longitudinal axis. The method and the chill mould are provided particularly for the manufacture of long, slender ingots, billets or the like, particularly for the manufacture of seamless tubes. Corresponding control of the cooling operation avoids fissures and facilitates ejection of the ingot from the chill mould. Moreover, the control of the cooling operation permits the formation of a uniform concentric cavity when manufacturing hollow ingots.

3 Claims, 2 Drawing Figures

CHILL CASTING METHODS

Figure 1:
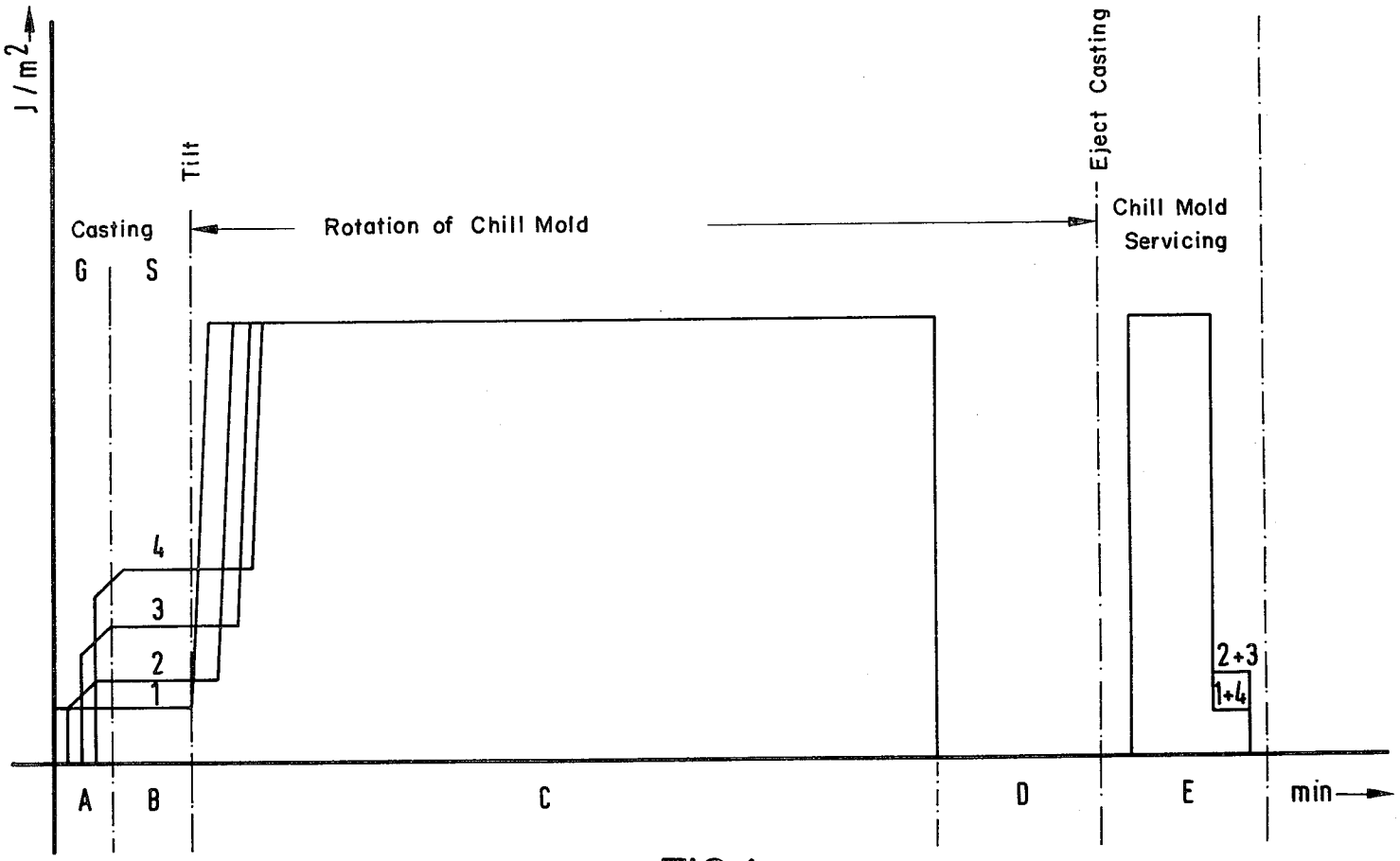

This invention relates to a method of chill casting and to chill moulds useful therein and particularly to a method of casting ingots utilizing thin wall moulds and controlled cooling of the casting.

When chill casting ingots in a conventional manner, chill moulds are used which have a relatively large wall thickness, so that the quantity of material required for the chill mould itself is larger than that of the ingot produced in the chill mould. In the first place, this large wall thickness results in great mechanical strength of the chill mould and, in the second place, chill moulds having large wall thicknesses such as this have a considerable heat absorption capacity, so that a solidified supporting skin zone of the ingot is rapidly produced without the chill mould expanding to any substantial extent during this critical phase of the solidification of the ingot. As a result of the large thermal capacity, the average temperature of the wall, and thus also the expansion of the chill mould, increase only very slowly in the first instance.

The costs of the moulds themselves are considerable in this conventional method of casting ingots, the large wall thickness of the chill moulds being a crucial cost factor. Thus, there has been no lack of endeavour to replace thick-walled chill moulds by other chill moulds.

The conventional casting chill moulds with their large wall thicknesses have the further disadvantage that they cannot be used to cast particularly long ingots, billets or the like, and it is difficult to exceed a length to diameter ratio of approximately 10:1 and, according to the material and the shape of the chill mould, this ratio frequently cannot even be achieved. The reason for this resides in the occurrence of longitudinal fissures, that is to say, fissures of greater or lesser depth in the surface of the ingot. When using conventional chill moulds, these fissures in the ingot occur because the outer skin of the ingot solidifies very rapidly during casting as a result of coming into contact with the cold, thick wall of the chill mould with which the outer skin is in close contact in the first instance. The outer skin of the ingot lifts from the wall of the chill mould as a result of shrinkage occurring during cooling of the ingot, so that a gap is formed between the outer skin of the ingot and the wall of the chill mould. When in this state, the outer skin of the ingot is no longer supported by the wall of the chill mould and cracks when it is subjected to a correspondingly high stress by too rapid a rise in the ferrostatic pressure which is caused by the melt itself. The stress generally occurs when ingots having a length to diameter ratio in excess of 10:1 are being cast, since, in the case of long ingots of this kind, the ferrostatic pressure of the melt still in a molten state in the interior of the ingot also becomes correspondingly high and stresses the still thin, unsupported outer skin of the ingot, so that the outer skin cracks. Ingots having these fissures cannot be used, since the fissures cannot be eliminated by economically justifiable means even during further processing.

In order to avoid these disadvantages, a chill mould having a relatively small wall thickness has already been developed which, for reasons of mechanical strength, has a support frame which externally surrounds the actual walls of the chill mould, the walls of the chill mould being supported on the support frame only by way of a number of small-area, preferably punctiform points of contact in order to minimize the transfer of heat. However, it is possible to use this known casting chill mould (German Offenlegungsschrift No. 24 46 505) to produce ingots, billets or the like of particularly great length, that is to say, having a length to diameter ratio of more than 10:1.

This known chill mould also enables the use of a known method (German Patent Specification No. 24 34 850) in which the melt is poured from above into an upright or slightly inclined chill mould at a high speed, the chill mould being closed immediately thereafter and subsequently being pivoted into the horizontal position in which it is rotated slowly about its longitudinal axis without given rise to any appreciable centrifugal forces. In this known method, the thin-walled chill mould is subjected to considerable thermal stress and consequently expands to a considerable extent even after a short period of time. This causes a considerable relative movement between the solidifying ingot and the interior wall of the chill mould, so that transverse cracks can appear. The greater is the length to diameter ratio, the greater is the occurrence of transverse cracks. Owing to the great length to diameter ratio, solidification in the bottom region of the chill mould takes place far earlier than in the upper portion into which the melt has been poured considerably later. The transverse cracks which occur are caused chiefly by this time and temperature difference.

An object of the invention is to provide a chill-casting method and a chill mould suitable for this method, in which method and in which chill mould the risk of the occurrence of cracks is ameliorated, even in the case of ingots having a length to diameter ratio of more than 10:1.

The invention comprises a method of chill-casting metal ingots, billets or the like, in which the molten metal is poured into a thin-walled chill mould, and in which the outsides of portions, disposed one above the other, of the walls of the chill moulds are separately subjected to coolant during casting, the bottommost portion being cooled first upon commencement of the casting operation but with a moderate intensity, and the portions located thereabove being subsequently cooled at successive intervals of time with increasing intensity, but with a high intensity, up to the topmost portion, commencing only shortly before the termination of the casting operation, and all the wall portions of the chill mould are cooled with the same high intensity during the solidification process, cooling being discontinued shortly before complete solidification and ejection of the ingot.

This in the first instance ensures that considered over the length of the chill mould, the melt is cooled far more uniformly than in conventional chill-casting methods, this being of great importance particularly when the length to diameter ratio is greater than 10:1. By virtue of the metering, of the coolant, the dissipation of heat can be controlled largely in accordance with the technical requirements of the method, since the thermal capacity of the thin-walled chill mould is negligible. By virtue of the cooling which is controlled and programmable according to time and intensity, a compromise between the partially mutually conflicting requirements imposed by the safeguarding of quality, freedom from cracks, ready removability of the ingots from the chill mould, high productivity and the like, can be obtained to an optimum extent. When manufacturing hollow ingots, the method in accordance with the invention is particularly advantageous for obtaining a satisfactory surface within the hollow, particularly a concentric, uniform configuration of the cavity.

Upon commencement of the casting operation, the upper portions of the wall of the chill mould remain uncooled and the bottommost portion is only cooled with a moderate intensity owing to the fact that the splashes of melt striking the interior wall of the chill mould in the region of the falling stream being poured will not cool to too great an extent, in order to ensure complete re-melting of the splashes. Furthermore, the graduation of the cooling is to ensure that the cooling is effected only to an extent that damage to the walls of the chill mould by, for example, melting, is avoided in the filled region of the chill mould. Furthermore, premature solidification in the bottom region is countered. Instead of this, the progressive increase in the dissipation of heat from the bottommost portion to the topmost portion results in the averaging of the solidifying layer, this being essential particularly in the case of ingots having a large cross section. The high cooling intensity during the solidification operation after the casting operation has ended increases productivity by accelerating the solidification of the melt to form the ingot by maximum dissipation of heat. By discontinuing the cooling operation shortly before the block has been completely solidified and ejected, the heat flowing out of the ingot heats the thin-walled chill mould to temperatures which lead to adequate expansion of the chill mould relative to the solidified ingot, thereby facilitating the ejection of the ingot.

Moreover, after the ingot has been ejected, it is advisable to cool all the portions of the walls of the chill mould with maximum intensity to the range of temperature favorable for servicing the chill mould. Cooling can then be controlled such that when applying, for example, aqueous chill mould black wash, the residual heat of the chill mould is still adequate completely to vaporize the water introduced therewith. It can then be taken into account that the central longitudinal portions of the chill mould are generally at a higher temperature than the top and bottom end portions, so that it is advisable to cool the central portions of the chill mould to a greater extent than the upper and lower portions, so that the temperatures of the walls of the chill mould are as uniform as possible even during the carrying out of maintenance on the chill mould.

The invention includes a chill mould whose moulded cavity is defined by a thin wall which is surrounded at a distance therefrom by a coolant-tight outer casing, the space thus formed being sub-divided by separating elements to form cooling chambers which are disposed one above the other and in which the associated portions of the walls of the chill mould are separately subjectable to different quantities of coolant.

In such a chill mould, the individual portions of the walls of the chill mould can be cooled with greatly differing intensities and at different times and at the same time, and thus the dissipation of heat from the melt or from the ingot can be very accurately controlled.

In an advantageous embodiment of the invention, the separating elements and thus the sizes of the cooling chambers and of the portions of the wall of the chill mould to be cooled, are individually adjustable. In this embodiment, it is advisable for the separating elements to be in the form of flap-like bottoms which are adjustable by means of externally accessible adjusting elements within the space between the outer casing and the wall of the chill mould.

In a further development of the invention, the cooling chambers are selectively interconnectable by way of closable and throttable connection lines and/or openings. This is also a measure for enabling control of the intensity of the cooling in the individual portions.

It is also particularly advantageous for the flow-through cross section of the inlet and/or outlet lines for the coolant of the individual portions of the wall of the chill mould to be closable and throttable. By throttling, for example, the return-flow line for the coolant, a higher pressure is obtained in the relevant cooling chamber than in the cooling chamber located thereabove, so that coolant cannot enter the first-mentioned cooling chamber from the cooling chamber located thereabove by way of any leaks existing between the two portions. In this manner, accurate sealing between the individual cooling chambers can be omitted without impairing the controllability of the intensity of cooling therebelow. This can be varied sensitively by the throttling of the inlet and/or outlet lines.

Figure 2:
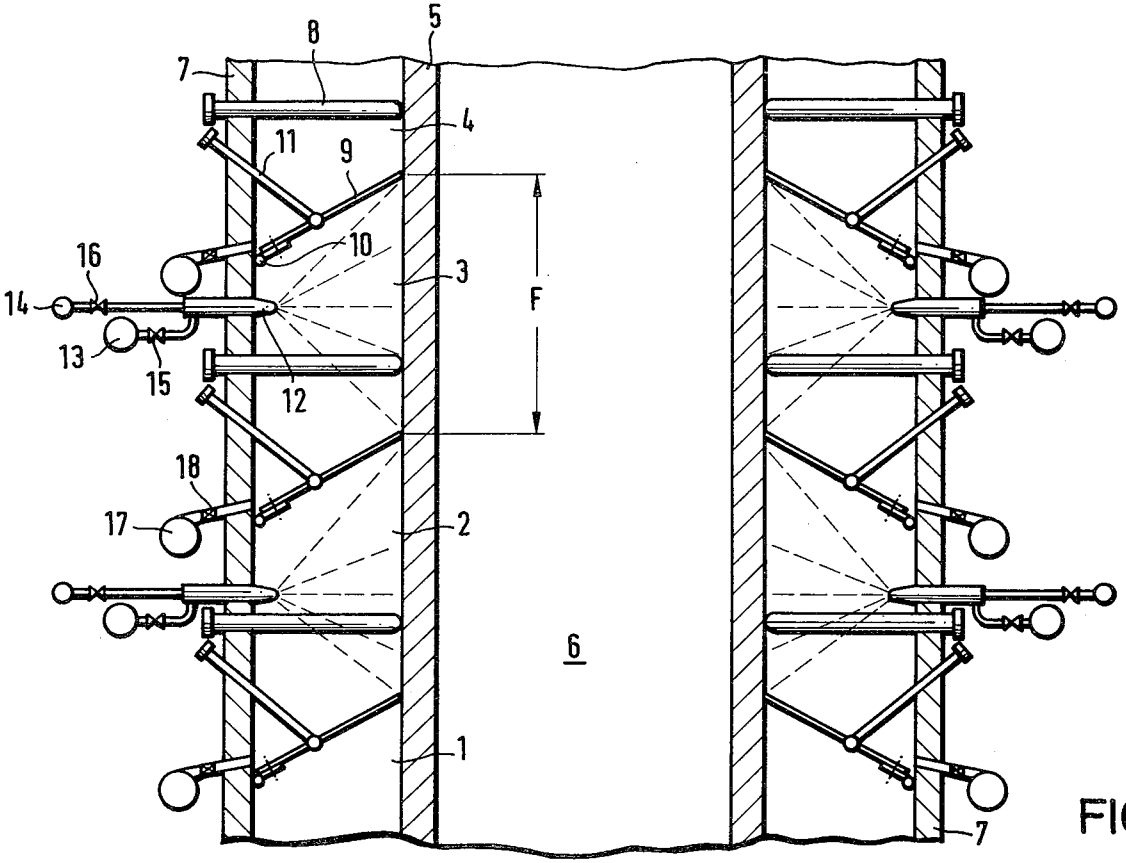

In the foregoing general description we have set out certain objects, purposes and advantages of this invention. Other objects, purposes and advantages of this invention will be apparent from a consideration of the following description and the accompanying drawings in which:

FIG. 1 is a heat/time graph pertaining to a chillcasting method in accordance with the invention; and FIG. 2 is a longitudinal section through a longitudinal portion of the chill mould in accordance with the invention.

FIG. 1 is a graph whose abscissa is subdivided into various time intervals (A to E). The heat dissipated per unit of area is plotted along the coordinate. Only one casting cycle is illustrated which, in practical operation, can be continuously repeated. It commences with the time interval A in which the chill mould is filled. The chill mould as, for example, four cooling chamber, this being clearly shown in the graph by the four curves. Cooling only takes place in the cooling chamber 1 in the first instance, although with only a low intensity. Cooling is also effected in the region of the cooling chambers 2, 3 and 4 at short intervals of time thereafter, the cooling intensity in the individual cooling chambers being perceptibly higher in each case. The chill mould is full during the time interval B, although it remains substantially vertical whilst it is being closed. The intensity of cooling in the individual cooling chambers 1 to 4 also differs during this period of time, although it remains substantially constant.

The casting chill mould is tilted into a substantially horizontal position at the end of the period of time B, slow rotation of the casting chill mould about its longitudinal axis being commenced at the same time. The intensity of cooling in all the cooling chambers 1 to 4 of the chill mould is increased to a maximum at the commencement of this period of time, designated C, first in the bottommost cooling chamber 1 and then successively at short intervals of time in the cooling chambers 2, 3 and 4 located thereabove. Maximum cooling is retained up to the end of the period of time C, the chill mould being continuously rotated. However, before this rotary movement is discontinued, that is to say, at the commencement of the period of time D, the cooling operation is completely discontinued. The heat flowing out of the ingot then provides the opportunity of heating the thinwalled chill mould over the period of time D, so that it expands and becomes detached from the ingot. This facilitates ejection of the ingot at the end of the period of time D.

All the cooling chambers 1 to 4 of the chill mould are cooled in the first instance with maximum intensity within the period of time E. The top and bottom cooling chambers 1 and 4, which in any case cool more rapidly, particularly due to the additional cooling of the end faces and cover by the atmospheric air independently of the coolant, are not cooled as intensely at the end of this last cooling operation as the two central cooling chambers 2 and 3 which have remained hotter. The cooling operation is subsequently discontinued. This is effected when the most favorable temperature of the chill mould for maintenance work on the chill mould has been established. The maintenance work is then carried out, and a fresh casting cycle can commence.

The chill mould only has four cooling chambers 1 to 4 in the embodiment described above, although this number of cooling chambers can be either larger or smaller.

FIG. 2 shows a relatively thin wall 5 of a chill mould. The wall 5 surrounds a chill mould interior 6 which can be filled with melt. FIG. 2 shows only a central longitudinal portion of the chill mould which can be a total of several meters long. The wall 5 of the chill mould is surrounded by an outer casing 7 which is coolant-tight and which at the same time serves as a support structure for the wall 5 of the chill mould. The wall 5 of the chill mould is supported on the outer casing 7 by bolts 8 which absorb a large portion of the mechanical stress which is exerted on the interior wall of the chill mould, particularly the stress caused by the ferrostatic pressure of the melt or the corresponding pressure in the case of a non-ferrous melt. The small areas of contact between the bolts 8 and the wall 5 of the chill mould allow the transfer of only a small, negligible quantity of heat from the wall 5 to the outer casing 7. The wall 5 of the chill mould has only a low thermal capacity owing to the fact that it is of small thickness and, consequently, there is no undesirable premature solidification of the melt in the region of the edge zones, which would lead to the longitudinal fissures.

Separating elements of flap-like construction are located on the inside of the outer casing 7 where they are secured by means of hinger 10. Externally accessible adjusting elements 11 in the form of setscrews render it possible to vary the slope of the flap-like adjusting elements 9, and thus render it possible to vary the portions F of the wall 5 of the chill mould.

A coolant, such as water, fed by way of a line 13, is sprayed by means of a nozzle 12 against the wall 5 of the chill mould in the region of the cooling chambers 1 to 4 which are formed in the manner just described. In the present embodiment, a second coolant, that is to say, air, is fed to the water by way of a line 14, so that a mixture of water and air serves as the coolant. Valves 15 and 16 in the inlet lines 13 and 14 render it possible to regulate the quantity of water as well as the quantity of air and thus at the same time also to regulate the pressure and the intensity of cooling in the region of the individual portions F. The coolant flows out of the cooling chambers 1 to 4 by way of outlet lines 17 which are also provided with valves 18, wherein the pressure in the interior of the cooling chambers 1 to 4 and the intensity of cooling can be regulated by throttling or opening the valves 18.

We have set out certain preferred practices and embodiments of our invention in the foregoing specification, however, it will be understood that this invention may be otherwise embodied within the scope of the following claims.

We claim:

1. A method of chill casting metal ingots, billets or the like comprising the steps of:

(a) pouring a metal to be cast into a thin walled chill mould;

(b) separately subjecting vertical increments of said chill mould to coolant during pouring whereby the bottommost portion is cooled first upon commencement of pouring with moderate cooling intensity, and the portions located thereabove being successively subsequently cooled at successive intervals of time with increasing intensity of cooling up to a maximum intensity of cooling at the top;

(c) subjecting the entire mould to the same high intensity cooling as soon as the pouring step is completed (d) discontinuing cooling shortly before complete solidification of the mould contents, and (e) completely solidifying the mould contents and ejecting the formed solidified product.

2. A method as claimed in claim 1, in which, after the ejection of the product, all the portions of the walls of the chill mould are cooled with maximum intensity to the range of temperature favorable to maintenance work on the chill mould.

3. A method as claimed in claim 1 or 2, in which the products have a length to diameter ratio in excess of 10:1.

* * * * *

UNITED STATES PATENT AND TRADEMARK OFFICE

CERTIFICATE OF CORRECTION

PATENT NO. : 4,487,247

DATED : December 11, 1984

INVENTOR(S) : HEINRICH FASTE; ALI BINDERNAGEL

It is certified that error appears in the above-identified patent and that said Letters Patent is hereby corrected as shown below:

Column 4, line 40, change "chamber" to --chambers--.

In Claim 1, line 40, after "pleted", insert --;--.

Signed and Sealed this

*Fourteenth* Day of *May 1985*

[SEAL]

*Attest:*

DONALD J. QUIGG

*Attesting Officer* *Acting Commissioner of Patents and Trademarks*